United States Patent [19]

DiMartino

[11] 4,212,251

[45] Jul. 15, 1980

[54] KEY ACTUATED STACKER LOCKING DEVICE

[75] Inventor: John M. DiMartino, Sayville, N.Y.

[73] Assignee: Line Fast Corporation, Holbrook, N.Y.

[21] Appl. No.: 855,918

[22] Filed: Nov. 30, 1977

[51] Int. Cl.[2] ..... B65D 21/02; B65D 25/20; B65J 1/22

[52] U.S. Cl. ..... 24/73 R; 410/69; 410/78; 220/1.5

[58] Field of Search ..... 105/366 B, 463, 464, 105/465, 484; 296/35 A

[56] References Cited

U.S. PATENT DOCUMENTS

| | | | |
|---|---|---|---|
| 2,439,423 | 4/1948 | Fowler | 105/464 |
| 3,193,238 | 7/1965 | Sherrie | 105/464 |
| 3,894,493 | 7/1975 | Strecker | 105/366 B |
| 4,023,504 | 5/1977 | Grey | 105/366 B |

*Primary Examiner*—Howard Beltran
*Attorney, Agent, or Firm*—Robert A. Kelly

[57] ABSTRACT

A selectively operable stacker key locking device adopted to secure containers either in a vertical or horizontal stacked relation or to secure a container to a base support. The locking device includes a first locking means comprising a base member, and extending upwardly from the base member is a neck member having a tubular shaped passageway extending therethrough having threads on the internal passageway thereof, and an elongated shank member having threads on the external sides thereof threadably rotatably mounted in the passageway of the neck member, a crosshead container locking member is connected to the shank member to control the rotation of the shank member such that when the shank member is rotated to cause the crosshead locking member to a locked position, the crosshead locking member is gathered against the internal wall of a container corner fitting to which the locking device is being affixed and when the shank member is rotated to cause the crosshead locking member to an open position the crosshead locking member is raised away from the internal wall of the corner fitting. The base member may have alternative second locking means depending from the base member such as twist lock devices or second locking means which are identical to the first locking means to secure the device to another container or to a base support.

4 Claims, 9 Drawing Figures

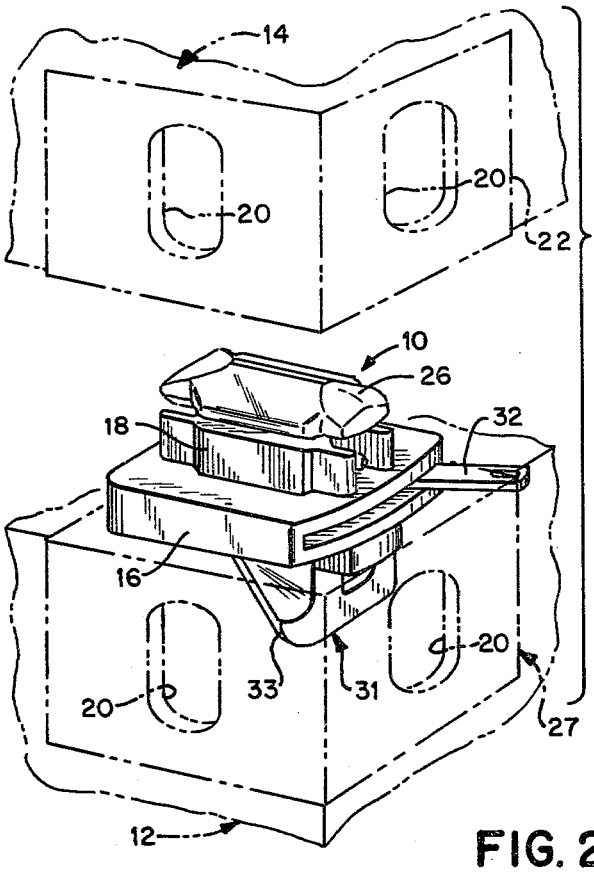
FIG. 1
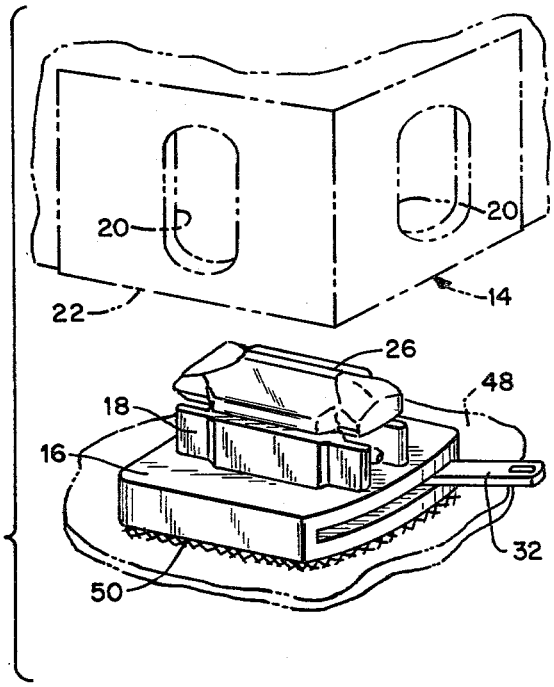
FIG. 2
FIG. 3
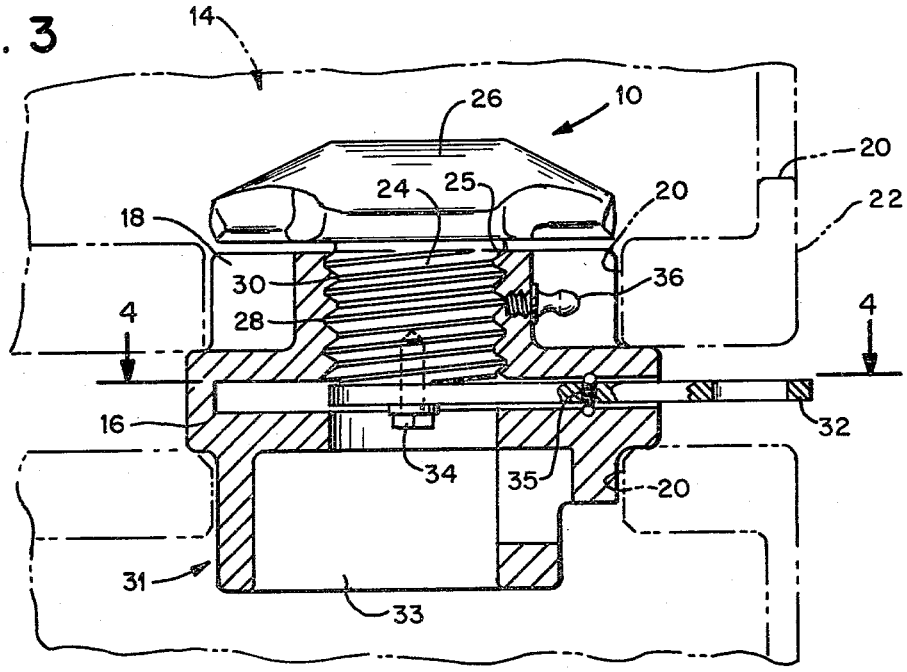

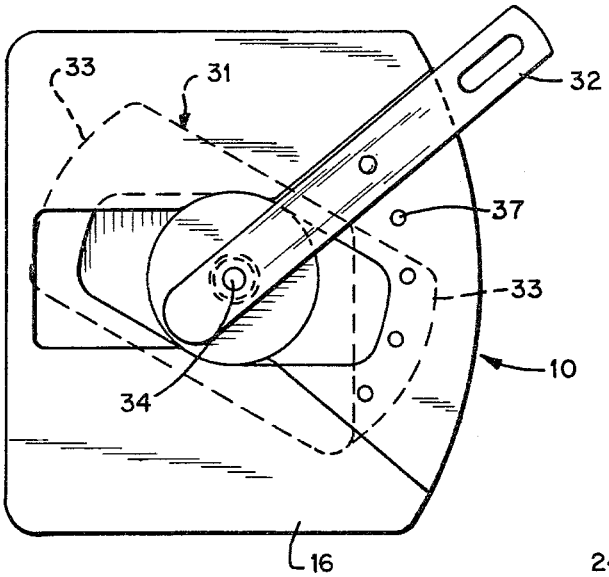
FIG. 4
FIG. 5
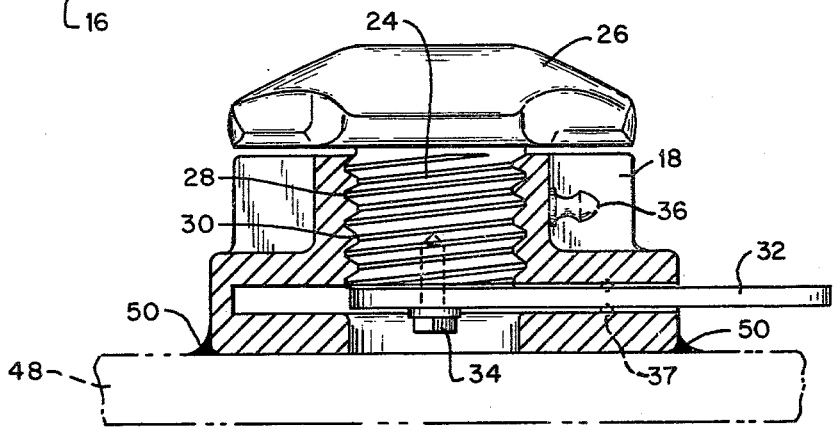
FIG. 6
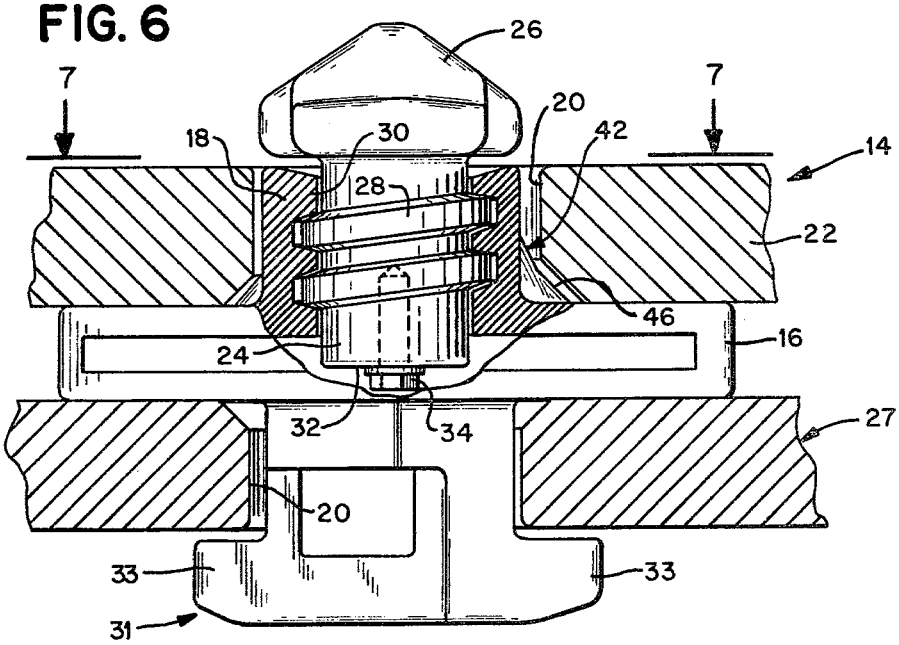

FIG. 7
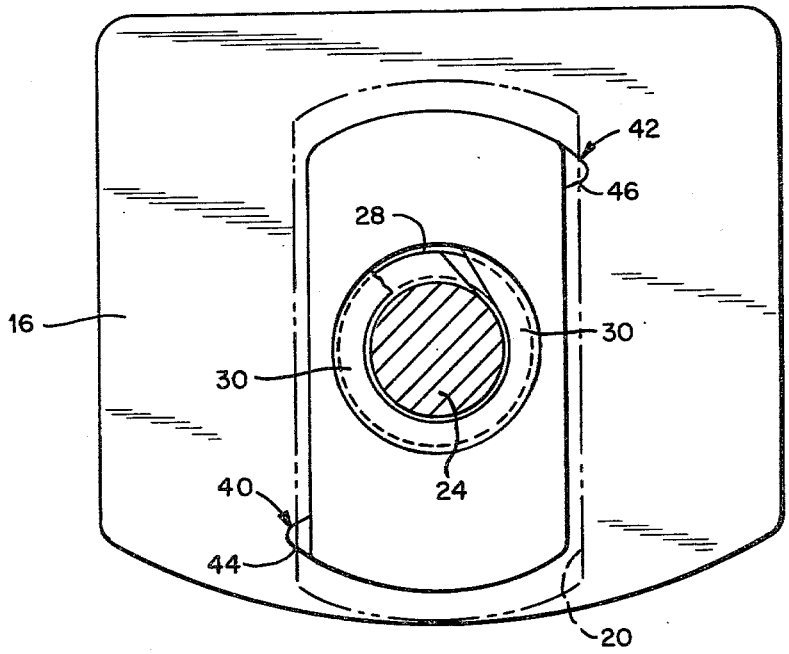
FIG. 8
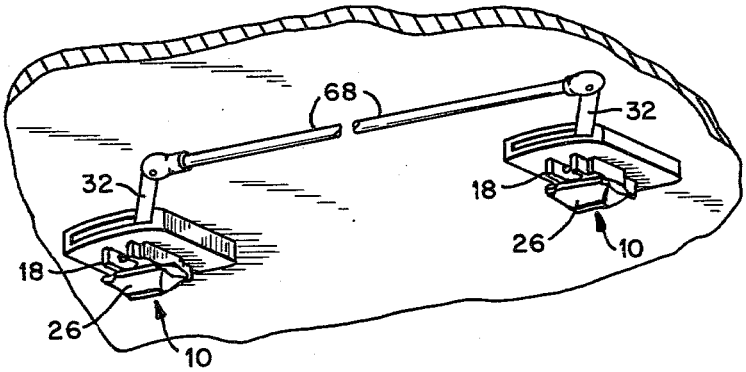
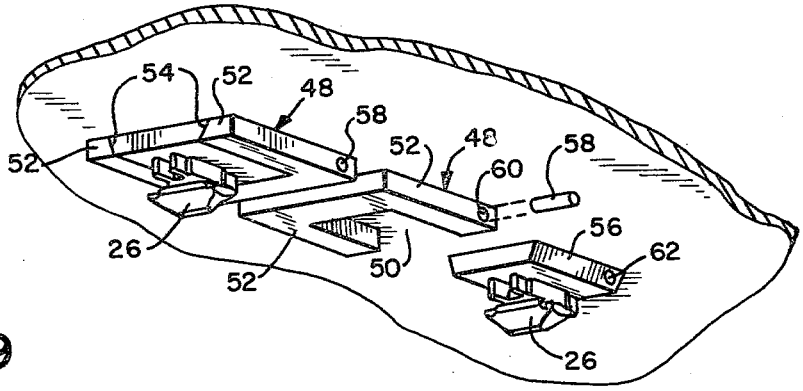
FIG. 9

KEY ACTUATED STACKER LOCKING DEVICE

BACKGROUND OF THE INVENTION

This invention refers to an apparatus and methods for releasably securing a freight container of standard type (ISO standard) to a loading platform and/or to another container within a stack of a multiplicity of such freight containers.

As is well known in the art, standard freight containers of the type described have at each corner fitting in which there is an elongate orifice in the horizontal face, the orifice opening into a recess within the corner fitting.

The state of the art is shown in U.S. Pat. No. 3,894,493 which teaches "A selectively operable stacker key locking device adapted to secure cargo containers either in vertical or horizontal adjacent stacked relation or to secure a container to a base support. The locking device includes a base member, a neck member and an elongated shank member to which a crosshead container locking member is connected. Internal means are provided to securely lock the shank member to the neck member thereby securing the container while several alternative means may be provided to secure the base member of the locking device to either another container or to a base support without interfering with the locking capability or functioning of the container locking features thereby providing independent alternative means to secure the locking device." The alternative device to secure the locking device can be a simple twist lock as shown described in said patent.

A problem which arises in the use of said type locks is that they are very subject to corrosion since they are often exposed to the elements in conventional use. This corrosion is very deleterious because it impedes movement between the lugs located on the shank member and the neck member thereof to lock these two pieces together. It can cause the cone portion thereof to be affixed in a locked position which prevents actuation of the lock by the key means.

Some conventional locking devices used in the art have a rotatable cone mounted on a shaft which is capable of being inserted in a ISO corner fitting orifice, with the cone being rotated thereafter to prevent the locking device from being removed from the corner fitting. In these devices when they are in a locked position the underside of the cone abuts the inner wall of the corner fitting. Here, too, corrosion can be very deleterious since no provision is made in such devices to urge the underside of the cone away from the innerside wall of the corner fitting to prevent it from being jammed up by the effects of corrosion.

The art has long sought a container interlock which is economic to produce, easily actuable and which can overcome the effect of corrosion buildup on interfaces between the lock surface and the container surface which can be safely installed on the containers and easily removed therefrom.

SUMMARY OF THE INVENTION

This invention is a selectively operable stacker key locking device adapted to secure a first member such as a cargo container to a base support or to secure a first member such as a cargo container to a second container in an adjacent stacked arrangement wherein at least one container includes a web portion having an opening therein. The device comprises a base member and a first locking means comprising a neck member affixed to the base member extending upwardly from the base member. The neck member is preferably dimensioned and configured to enter the opening of the web and defines an inner open tubular shaped passageway which extends therethrough. An elongated shank member extends upwardly from the base member and through the inner opening of the neck member being rotatably mounted within the neck member. A crosshead member is affixed to the upper end of the shank member, the crosshead member having at least one elongated flange dimensioned and configured to enter the web opening when aligned therewith in a first position. The crosshead member is rotatable to a second locking position such that at least one dimension of the crosshead exceeds a corresponding dimension within the web. The wall of the passageway in the neck member having threads thereon which are mateable with threads on the external surface on the shank member to prevent the shank member from being drawn out of the neck member when the crosshead is in either the locked or unlocked position. This screw thread type arrangement also provides a gathering action between the crosshead member and the internal side of the web when the crosshead member is moved to the locked position therewith and to urge the crosshead member away from the internal side of the web when the crosshead member is being rotated to the unlocked position. Key means are provided to rotate the shaft. Means are further provided on the lower portion of the base member for attaching the base member to a lower support means. These may include several alternative securing means as will be seen.

A second locking means similar in structure and operation to the first locking means depending from the base member actuable by the key means employed for the first locking means or having independent key means whereby the first locking means and the second locking means are independently actuateable.

In a preferred embodiment, a twist lock device is provided in the lower portion of the base member having an elongated flange member for positioning into an opening in the web in the upper corner of the container in a first position and is rotatable to a second locking position whereby the dimensions of the flange member exceeds the dimensions of the opening to prevent removal of the base member out of the opening of the container. In this embodiment a second container is placed on the first container and container lock and the crosshead is rotatable to a locked position for securely locking the two containers together in vertical stacked relation.

Another feature of the container lock provides securing of a container to a base member such as a deck of a vessel or a hatch cover by a fusion-welded bead between the base member and the base support and extending about at least a portion of the periphery of the base member.

The container locking features of the present invention extend from the base member upwardly to the crosshead while the shank member does not extend through the entire unit. This permits versatility in the selection of several independent types of base attachments such as a twist lock, a fusion-weld, or even a clamp means. Due to the strength requirements of such locking devices, the prior art devices have incorporated securing means having a shaft extending entirely through the unit while utilizing external securing means and thus precluding alternate applications such as those which are possible with the present invention. The present invention can be fabricated to exceed strength requirements to damage corner castings and facilitates ease of manufacture with simplified replacement of any parts required. The unique internal and integral securing lugs, combined with the cast steel base member which is integrally formed with the neck member, combines desirable attachment strength with lightness of weight and reduced manufacturing costs.

DETAILED DESCRIPTION OF THE DRAWINGS

Preferred embodiments of the invention are described hereinbelow with reference to the drawings wherein:

FIG. 1 is a perspective view of a stacker key container locking device having a twist lock base;

FIG. 2 is a perspective view of an alternate embodiment of the stacker key container locking device;

FIG. 3 is a partial cross-sectional view of the stacker key container locking device shown in FIG. 1;

FIG. 4 is a cross-sectional view taken along the lines 4—4 of FIG. 3;

FIG. 5 is a partial cross-sectional view of the stacker key container locking device shown in FIG. 2;

FIG. 6 is a partial cross-sectional view of t preferred embodiment of the stacker key container locking device;

FIG. 7 is a view taken along lines 7—7 of FIG. 6 illustrating a preferred feature of the invention;

FIG. 8 is illustrative of an alternate embodiment of the invention illustrating a preferred application thereof; and FIG. 9 is an illustration of another preferred embodiment of the invention.

DETAILED DESCRIPTION OF THE PREFERRED EMBODIMENTS

In the following description the terms upwardly, downwardly, inwardly, outwardly, above and beneath are used for descriptive purposes only. It should be understood that they are not intended to limit the invention or use thereof to any particular orientation or position.

Referring to the drawings there is shown in FIG. 1 a preferred stacker key container locking device 10 positioned on top of a lower container 12 with an upper container 14 in position about to be lowered onto the lower container 12. The locking device 10 includes a base member 16 and a vertical neck member 18 affixed to the base member 16 and extending upwardly therefrom. The base member 16 and the neck member 18 may be of any suitable material having the strength required to firmly secure such containers. However, it is preferred that the base member 16 and the vertical neck member 18 are fabricated integrally of cast steel. The neck member 18 is preferably elongated as shown and dimensioned and configured to enter the substantially elongated opening 20 of a web 22 forming part of a corner casting of a container as shown in the drawings. When the stacker key locking device is used for such vertical stacking it is contemplated that the crosshead and neck members will enter the lower horizontal web member of the corner casting on the bottom portion of the upper container as will be described.

Referring now to FIG. 3, there is shown an elongated shank member 24 extending upwardly from the base member 16, through an inner open position 25 of neck member 18 and rotatably mounted thereto. A crosshead member 26, which is preferably partially conical and elongated as shown, is dimensioned to be aligned with the elongated opening 20 in web 22 of the corner casting while it is in a first unlocked position. The crosshead is preferably fabricated of cast steel integrally with the shank member 24. The container is lowered to the extent that the web member 22 clears the crosshead member 26 and the vertically extending neck member 18 enters the substantially elongated opening as shown in FIG. 3.

Threads 28 are provided on opposite surfaces of the elongated shank member 24 and correspondingly configured and postioned threads 30 are provided on the opposed corresponding surface portions of the inner portions of neck member 18 as shown in FIG. 3. When the shank member 24 and crosshead member 26 are rotated to the locked position the crosshead member 26 is gathered into a snug relationship with a portion of web 22 and when the crosshead member 26 is rotating to the unlocked position it is moving away from web 22. Thus the invention provides a component of motion which is not found in similar type locking devices which eliminates problems caused by corrosion on the surface of the crosshead member 26 and/or the surface of web 22 which is in contact with the surface of crosshead member 26, which corrosion has caused such devices to jam up preventing the device from both opening or closing. Further threads 28 and 30 prevent the shank member 24 from being withdrawn from neck member 18 merely by the application of a force along the longitudinal axis thereof.

Rotation of shank member 24 is easily accomplished by moving handle 32 which is connected to shank member 24 by bolt 34 as shown in FIG. 6. It must be borne in mind that threads 28 and 30 acting as a screw jack when operating in conjunction with handle 32, which handle is in effect a simple lever, provides tremendous mechanical advantage in effectuating the desired raising and lowering of crosshead member 26 with respect to web 22 and base member 16. The degree of raising and lowering of crosshead member 26 with respect to web 22 and base member 16 can be varied by selecting a particular angle of slope for threads 28 and 30.

Grease fitting 33 is provided in neck member 18 in FIG. 3 to permit greasing of the threads 28 and 30 and the space between neck member 18 and shank member 24 to both limit the effects of atmospheric corrosion and facilitate rotation of the shank member 24 in neck member 18. Detente means 35 made up of a spring having a ball mounted in each end of the spring is located in tubular slot in handle 32 as shown in FIG. 3, the detente means 35 being held in place by compression of the spring when the handle 32 containing the detente means 35 is inserted within the slot of the base member 16, detente stops 37 which are dimples in the walls of the slot of the base member 16, in which the handle 32 rides as shown in FIG. 4 and so placed as to permit a portion of the balls of the detente means 35 to enter the detente stops 37 and to releaseably engage said balls of the detente means 35 and releaseably restrict the motion of the handle 32 in the slot of base member 16. The use of a series of detente stops allows for a series of stop positions on the motion of the handle and allows for the use of my devices on webs 22 which have a variety of thicknesses.

Referring further to the drawings it can be seen that the basic container locking features of the present invention are substantially embodied in the base member 16, neck member 18, shank member 24 and crosshead 26. The shank member 24 does not extend through the entire unit. The invention thus provides several alternative means for securing the container lock to the lower member without affecting the basic container locking capability of the container stacker key locking device.

For example, in FIG. 1 there is shown a preferred means for securing the container lock 10 to a lower container 12 in a manner which provides for locking of containers in vertical stacked relation. A twist lock 31 includes an elongated flange member 33 configured and dimensioned to be insertable into a substantially elongated opening 20 in web 22 of a container corner casting 27 of a lower container 12. The flange is movable by a rotation or twisting motion of the entire container locking device 10 to a second (or locked) position in which the dimensions of the flange exceed the dimensions of the substantially elongated opening so as to prevent the twist lock 31 as well as the entire locking device 10 from being removed from the container. When the second container 14 is stacked in vertical alignment with the lower container 12 as shown, the crosshead 26 and vertical neck member 18 enter the substantially elongated opening in the web 22 on the lower portion of the corner casting of the upper container 14 as shown in FIG. 3. By rotation of the handle 32 the shank member 24 and crosshead member 26 are rotated to a position in which the crosshead member is locked within the web 22 as shown in FIG. 6

Referring now to FIG. 7, there is shown an additional feature which may, if desired, be utilized in conjunction with the embodiment having the twist lock base as shown in FIGS. 1, 5 and 6. Neck member 18 is asymmetrically configured at both end portions to include buttresses 40 and 42 having respective sloped surfaces 44 and 46 extending from the side surface portion of the neck member 18 downwardly and outwardly (or laterally) to the base member 16 as shown in the partial cross-sectional views in FIG. 6 and FIG. 7. Thus, it can be seen that when the upper container 14 is lowered onto the stacker key container lock 10 as is shown in FIG. 6, the neck member 18 will enter elongated opening in the horizontal web member 22 on the lower side portion of the lower corner casting 27 of the upper container and the web member 22 will engage the asymmetric buttresses 40 and 42 thereby causing the stacker key container locking device to rotate or twist in a direction which will result in the maximum engagement between the twist lock 31 of the base member and the horizontal upper web member 22 of the upper portion of the upper corner casting 27 of the lower container 12. This unique feature thus actually utilizes the container stacking arrangement as well as the weight of the upper container or containers to maintain a bias between the twist lock 31 of the base member so as to maintain it in a fully locked position with respect to the lower container. Thus, maximum locking capability is obtained. At the same time the shank member 24 is rotatable to a locking position which places the crosshead member 26 in a locked position with respect to the upper container 14. This provides a unique system of stacking and securing such containers in a vertical arrangement.

Another feature of the present invention is shown in FIGS. 2 and 5 in which the base member is conveniently attached to a base support such as a vessel deck or hatch cover 48 by a fusion-welded bead 50. Other means of attaching the base member to a base support known to those skilled in the art such as by clamping, bolting and the like are also contemplated within the scope of the invention. It can be seen that a single tier of containers may be secured to a base support such as a hatch cover 48 as shown in FIG. 2 or alternately, additional tiers of containers may be stacked on the first tier using the stacker key container lock having a twist lock base according the embodiment of FIG. 1.

In FIG. 8 there is shown a feature of the invention whereby a plurality of stackey key container locks 10 are positioned on an overhead support base (or alternately a lower support base, not shown) and positioned corresponding to the corner castings of at least one container. Interconnecting linkages 68 are provided and secured to the handles of each locking device such that a single locking lever is rotated to lock all of the container locks simultaneously. In such an arrangement either a single container or a plurality of containers may be placed on the requisite corresponding number of container locks after which rotation of a single lever actuates numerous interconnecting linkages thereby rotating a plurality of shank members and crossheads connected thereto and securing numerous containers to a base support at the same time.

Still another feature contemplated as part of the invention is illustrated in FIG. 9 wherein several stacker key container locks 10 are secured to an overhead support base (or alternately a lower support base, not shown) provided with key retainers 48 each having an opening 50 defined by members 52 having sloped surfaces 54 forming a dovetail interlocking means. Oppositely sloped mating surfaces 56 are provided on the base member 66 of the locking device 64 such that the container lock may be slidably positioned within the key retainers and preferably finally secured by inserting locking pins 58 in opening 60 in the key retainer 48 and opening 62 in the base member. In the preferred form four stacker key container locks 10 are positioned to correspond to each lower or upper (depending upon the installation) corner casting of the container to be secured.

Wherein I claim:

1. A selectively operable stacker key locking device adapted to secure a first corner fitting of a first shipping container to a second corner fitting of a second container in an adjacent stacked relation, each of the corner fittings having a web portion defining an elongated opening therein comprising:

a. a planar base member adapted to keep the first and second corner fittings in a spaced apart relationship when inserted therebetween;

b. a neck member affixed to said planar base member and extending upwardly therefrom, said neck member being dimensioned and configured to enter the opening of a web portion of the first corner fitting and neck member defining an inner open portion which extends therethrough having a first set of screw threads on the wall of the neck defining the inner open portion thereof;

c. an elongated shank member extending upwardly from said planar base member and through the open portion of the neck member, said shank member being rotatable within the neck member and having a second set of screw threads on the outer portion thereof, said second set of threads being mateable and capable of co-acting with said first set of threads in said neck member;

d. a crosshead member affixed to the upper end of the shank member, said crosshead member having at least one elongated flange dimensioned and configured to enter the opening defined by a web portion of the first corner fitting when aligned therewith in a first position and rotatable to a second locking position such that at least one dimension of the crosshead exceeds a corresponding dimension of the web opening to lock the crosshead member within the web;

e. an elongated handle substantially rigidly connected to the shank member, said handle extending outwardly through the base member such that rotation of the handle from a first position to a second position results in a corresponding rotation of the crosshead from said first position to said corresponding second locking position;

f. the bias of said first set of screw threads and said second set of screw threads being set in a direction such that when said shank portion is rotated in the inner open portion of the neck to rotate the crosshead member to a second locking position the crosshead member is directionally gathered closer to the base member and that when said shank portion is rotated in the open portion of the neck to rotate the crosshead member to said first position the crosshead member is directionally urged apart from the base member;

g. means on the lower portion of the base member for attaching the planar base member to a second corner fitting on a second container; and h. means for greasing said threads through said neck portion.

2. The selectively operable stacker key locking device according to claim 1 wherein the means on the lower portion of the planar base member for attaching the planar base member to a second cargo container comprises a twist lock having a flange member dimensioned and configured to enter the elongated opening of the web portion of a second corner fitting on a second container in a first unlocked position and rotatable to a second locked position in which the dimensions of the flange exceed the dimensions of the opening.

3. The selectively operable stacker key locking device according to claim 2 wherein the neck member and the crosshead member have elongated configurations suitable for entrance into an elongated opening in a web of a corner fitting of a cargo container so as to facilitate securing cargo containers in a vertical stacked arrangement.

4. The selectively operable stacker key locking device according to claim 3 wherein the elongated neck member includes two side end portions and the neck member further comprises one asymmetric lateral buttress extending sidewardly from each side end portion of the neck member in opposite directions with respect to each other, said buttresses having side surfaces which slope downwardly and laterally, said side surfaces being configured such that when the planar base member is inserted into the upper web portion of a corner fitting of a lower cargo container, a web of a corner fitting of an upper cargo container positioned on the lower container in a manner in which the neck member and crosshead member enter an elongated opening defined by a web portion of the corner fitting of the upper cargo container, said web portion engages said buttresses in a manner which produces further locking rotation of the twist lock device with respect to the web member of the lower cargo container to increase the locking capability of the twist lock.

* * * * *